US008758077B2

(12) United States Patent
Jang et al.

(10) Patent No.: US 8,758,077 B2
(45) Date of Patent: Jun. 24, 2014

(54) FIGHTER ROBOT SYSTEM

(75) Inventors: Hong-Min Jang, Seoul (KR); Seong-Hoon Lee, Seoul (KR)

(73) Assignee: Robobuilder Co., Ltd., Seoul (KR)

( * ) Notice: Subject to any disclaimer, the term of this patent is extended or adjusted under 35 U.S.C. 154(b) by 369 days.

(21) Appl. No.: 12/795,100

(22) Filed: Jun. 7, 2010

(65) Prior Publication Data

US 2010/0311304 A1 Dec. 9, 2010

(30) Foreign Application Priority Data

Jun. 8, 2009 (KR) ..... 10-2009-0050595

(51) Int. Cl.
*A63H 13/06* (2006.01)
*A63H 29/22* (2006.01)

(52) U.S. Cl.
USPC ..... 446/334; 446/359; 446/484

(58) Field of Classification Search
USPC ..... 446/82–84, 236, 330, 333, 334, 359, 446/361, 363, 484; 472/7, 10; 40/411, 414, 40/415, 418–420; 273/108.1
See application file for complete search history.

(56) References Cited

U.S. PATENT DOCUMENTS 359,317 A * 3/1887 Fischer ..... 446/261
463,927 A * 11/1891 Wada ..... 446/334
1,167,958 A * 1/1916 Watkins ..... 446/362
1,684,796 A * 9/1928 Habicht ..... 472/7
1,722,922 A * 7/1929 Johnson ..... 472/10
1,769,414 A * 7/1930 Brandon et al. ..... 472/10
1,811,818 A * 6/1931 Parris ..... 40/477
2,135,606 A * 11/1938 Stuve ..... 40/415
2,368,805 A * 2/1945 Clark ..... 472/7
2,496,725 A * 2/1950 Hotcaveg ..... 446/335
3,055,660 A * 9/1962 Alexander ..... 472/7
3,722,135 A * 3/1973 Jacobson ..... 446/425
3,762,702 A * 10/1973 Keele et al. ..... 472/10
3,907,285 A * 9/1975 Lettieri ..... 472/11
3,927,883 A * 12/1975 Bosley et al. ..... 273/440.1
4,135,711 A * 1/1979 Holt ..... 472/10
4,299,386 A * 11/1981 Kulesza et al. ..... 463/8
4,609,195 A * 9/1986 Ham ..... 273/440.1
4,824,417 A * 4/1989 Jackson ..... 446/335
4,995,610 A * 2/1991 Paoletti ..... 463/8
5,042,807 A * 8/1991 Sasakawa et al. ..... 273/440.1
5,868,076 A 2/1999 Myus et al.
5,941,196 A * 8/1999 Domanski ..... 119/708

(Continued)

FOREIGN PATENT DOCUMENTS

KR 10-2002-0016759 A 3/2002

*Primary Examiner* — Gene Kim
*Assistant Examiner* — Alyssa Hylinski
(74) *Attorney, Agent, or Firm* — Birch, Stewart, Kolasch & Birch, LLP

(57) ABSTRACT

A fighter robot system that supplies power to two fighter robots, which have a match against each other, through respective power lines and prevents the power lines from becoming entangled even when the robots are moving. The fighter robot system includes two fighter robots, a power supply providing power to the fighter robots, and a rotary member located above or below the fighter robots, the rotary member having a predetermined length and rotatable around a central axis formed at a predetermined portion. The power supply provides the power to the fighter robots through power lines. Each power line starts from the power supply, extends from the central axis to either end of the rotary member in the lengthwise direction, and is connected at that end to each fighter robot. The rotary member rotates around the central axis following the movement of the fighter robots.

7 Claims, 4 Drawing Sheets

(56) References Cited

U.S. PATENT DOCUMENTS 6,044,767 A 4/2000 Myus et al.
6,273,782 B1 * 8/2001 Chan et al. ..... 446/356
6,682,392 B2 * 1/2004 Chan ..... 446/335
6,796,871 B1 * 9/2004 Hsieh ..... 446/228
7,788,840 B2 * 9/2010 Wyant et al. ..... 43/3
2003/0216101 A1 * 11/2003 Chang ..... 446/84

* cited by examiner ( a ) ( b )

FIGHTER ROBOT SYSTEM

CROSS REFERENCE TO RELATED APPLICATION

The present application claims priority to Korean Patent Application Number 10-2009-0050595 filed on Jun. 8, 2009, the entire contents of which application is incorporated herein for all purposes by this reference.

BACKGROUND OF THE INVENTION

1. Field of the Invention

The present invention relates to a fighter robot system, and more particularly, to a fighter robot system that supplies power to two fighter robots, which have a match against each other, through respective power lines and prevents the power lines from becoming entangled even when the robots are moving.

2. Description of Related Art

The robotics industry is developing every day, and is expected to become one of the important industries that determine national competitive power in the future. Recently, various types of robots are being developed in response to improvements in robot technology. For example, pet dog robots in the form of puppies, cleaner robots, which serve to clean indoor spaces, fighter robots, which have a match against each other in a predetermined space, and the like are distributed in the market. These robots are fabricated according to their respective uses.

These robots are provided with a separate battery and can operate until the battery is exhausted. Therefore, the robots stop operating in response to the exhaustion of the battery after the elapse of a certain time. In this case, it is inconvenient to recharge or replace the battery.

Attempts to supply power without wires have been made in order to solve these problems. For example, Korean Patent No. 0438255 and U.S. Pat. Nos. 5,868,076 and 6,044,767 are technologies that supply DC power by supplying positive and negative voltages to electric devices, such as electric vehicles, through a plurality of conductor panels provided on the underside.

These technologies may be suitable for electric devices that remain in constant contact with the panels, since the plurality of conductor panels is provided across the underside in order to supply power and the electric devices or the like are powered through the conductive panels. However, it is difficult to stably supply power to upright fighter robots, which walk upright with two legs, since the feet of the robots are frequently separated from the panels. In addition, it is troublesome since a circuit for rectifying power supplied through the conductor panels should be provided inside each robot.

Accordingly, it is preferred that power be supplied through separate power lines in order to stably supply power to the fighter robot. However, when power is supplied to the fighter robot through wires, the movement of the robot is greatly limited. In particular, as two fighter robots move individually, the two power lines connected to the robots tend to be entangled, thereby limiting the movement of the robots.

Accordingly, in the art, there is demand for the development of a technology that can stably supply power to two fighter robots, which have a match against each other, through power lines while preventing the power lines from becoming entangled even when the robots are moving.

The information disclosed in this Background of the Invention section is only for the enhancement of understanding of the background of the invention and should not be taken as an acknowledgment or any form of suggestion that this information forms the prior art that would already be known to a person skilled in the art.

BRIEF SUMMARY OF THE INVENTION

Various aspects of the present invention provide a fighter robot system that can stably supply power to two fighter robots, which have a match against each other, through respective power lines while preventing the power lines from becoming entangled even when the robots are moving Also provided is a fighter robot system that allows two fighter robots, which are powered through the power lines, to move freely without the power lines being entangled.

Also provided is a fighter robot system that minimizes the limitation of the operation of fighter robots by ensuring that the arms of the robots do not come into contact with the power lines.

In an aspect of the present invention, the fighter robot system may include two fighter robots configured to have a match against each other, the fighter robots being powered through wires, a power supply providing power to the fighter robots, and a rotary member located above or below the fighter robots, the rotary member having a predetermined length and rotatable around a central axis formed at a predetermined portion. The power supply provides the power to the fighter robots through power lines, each of the power lines starts from the power supply, extends from the central axis to either end of the rotary member in the lengthwise direction, and is connected at that end to a corresponding one of the fighter robots. The rotary member rotates around the central axis following the movement of the fighter robots, thereby preventing the power lines from becoming entangled According to an exemplary embodiment of the invention, the rotary member can include a first entanglement-preventing means provided on the central axis, wherein the first entanglement-preventing means prevents the power lines extending from the power supply from becoming entangled on the central axis.

According to an exemplary embodiment of the invention, the rotary member can include a second entanglement-preventing means on opposite ends thereof, wherein the second entanglement-preventing means prevents the power lines connected to the two fighting robots from becoming entangled with each other or themselves.

According to an exemplary embodiment of the invention, the rotary member can include a third entanglement-preventing means provided on the upper portions of the two fighting robots, wherein the third entanglement-preventing means prevents the power lines connected to the two fighting robots from becoming entangled with each other or themselves.

According to an exemplary embodiment of the invention, the rotary member can be configured as a cylindrical body having a predetermined length such that the power lines are provided inside the cylindrical body.

According to an exemplary embodiment of the invention, the rotary member can include a shaft provided on the central axis thereof.

According to an exemplary embodiment of the invention, portions of the power lines between one end of the rotary member and one fighting robot and between the other end of the rotary member and the other fighting robot can be varied in length in order to freely correspond to the movement of the fighting robots. Here, each of the power lines can be configured as a spiral such that the length thereof is variable.

According to an exemplary embodiment of the invention, the fighter robot system may also include a controller that controls the fighting robots by providing control signals to the fighting robots with or without wires. Here, it is possible to provide the power and the control signals to each of the fighting robots through one power line. In addition, the power can be alternating current power, and power line communication can be employed to provide the control signals on the alternating current power to the robots.

According to an exemplary embodiment of the invention, each of the fighter robots can be set to operate arms so that the arms do not come into contact with the power line connected to the robot.

According to exemplary embodiments of the present invention as set forth above, it is possible to allow the two fighter robots to move freely by stably supplying power to the fighter robots through the power lines connected to the robots while preventing the power lines from becoming entangled.

In addition, it is possible to prevent the problem of disconnection of the conductors inside the power lines caused by the entanglement of the power lines connected to the fighter robots or short-circuit caused by peeling of the cover.

Furthermore, according to an exemplary embodiment of the invention, it is possible to prevent the power line connected to each fighter robot from limiting the operation of the robot since the entanglement-preventing means is provided to the robot.

Moreover, according to an exemplary embodiment of the invention, it is possible to prevent the power line connected to each fighter robot from limiting the operation of the robot since the operation of the arm of the robot is set in advance so that the arm does not come into contact with the power line.

The methods and apparatuses of the present invention have other features and advantages which will be apparent from or are set forth in greater detail in the accompanying drawings, which are incorporated herein, and in the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
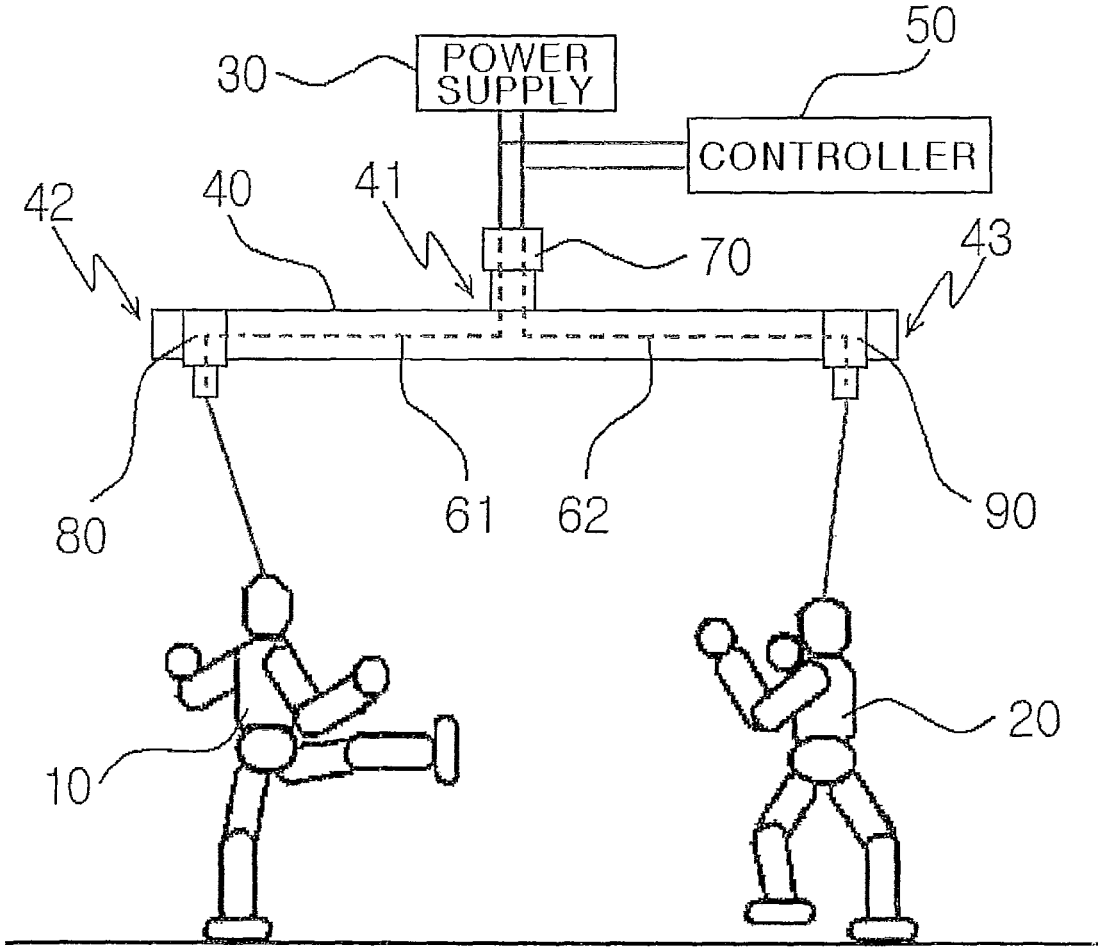
FIG. 1 is a schematic view showing a fighter robot system according to an exemplary embodiment of the invention.

FIG. 1 is a schematic view showing a fighter robot system according to an exemplary embodiment of the invention.

Referring to FIG. 1, the fighter robot system according to an exemplary embodiment of the invention includes fighter robots 10 and 20, a power supply 30, and a rotary member 40. In addition, the fighter robot system may also include a controller 50, according to another exemplary embodiment of the invention.

The fighter robots 10 and 20 are robots that have a match against each other in a certain space. Although two fighter robots are shown in the drawing by way of example, one or two or more fighter robots can be provided according to another exemplary embodiment of the invention. However, the invention preferably provides two fighter robots that are configured to have a match against each other. The fighter robots 10 and 20 are powered through power lines 61 and 62 from the power supply 30.

The power supply 30 serves to supply power to the fighter robots 10 and 20 through the power lines 62 and 62. Here, the power supplied to the robots 10 and 20 can be Alternating Current (AC) or Direct Current (DC) power.

The rotary member 40 has a certain length and can be arranged above or below the fighter robots 10 and 20. The drawing shows, by way of example, a configuration in which the rotary member 40 is arranged above the robots 10 and 20. The rotary member 40 is designed to be rotatable around a central axis 41 formed in a certain portion thereof. The central axis 41 can be located in the central portion of the rotary member 40. In an exemplary embodiment of the invention, the rotary member 40 can be configured as a hollow cylinder so that the power lines 61 and 62 can be housed therein.

As described above, according to an exemplary embodiment of the invention, the power supply 30 supplies power to the fighter robots 10 and 20 through the power lines 60 and 61. The power lines 61 and 62 start from the power supply 30, extend from the central axis 41 to opposite ends 42 and 43 of the rotary member 40 in the lengthwise direction, and are connected from the opposite ends 42 and 43 to the fighter robots 10 and 20 located below. As such, the fighter robot 10 is connected to one end 42 of the rotary member 40 via the power line 61, and the fighter robot 20 is connected to the other end 43 of the rotary member 40 via the power line 62. Accordingly, the rotary member 40 can rotate around the central axis 41 following the movement of the fighter robots 10 and 20, thereby preventing the two power lines 61 and 62 from becoming entangled.

For this purpose, the rotary member 40 according to an exemplary embodiment of the invention includes a first entanglement-preventing means on the central axis 41 in order to prevent the power lines 61 and 62, provided from the power supply 30, from becoming entangled on the central axis 41 when the central axis 41 is rotating. In other words, the first entanglement-preventing means 70 serves to prevent the power lines 61 and 62, connected to the fighter robots 10 and 20 through the rotary member 40, from becoming entangled on the central axis 41 when the rotary member 40 is rotating.

In addition, the rotary member 40 according to an exemplary embodiment of the invention can also include a second entanglement-preventing means 80 and 90 on the opposite ends 42 and 43 of the rotary member 40, respectively. The second entanglement-preventing means 80 and 90 prevents the power lines 61 and 62, connected from the power supply 30 to the fighter robots 10 and 20 through the rotary member 40, from becoming entangled with each other on the opposite ends 42 and 43 or themselves when the rotary member 40 is rotating around the central axis 41.

Furthermore, in an exemplary embodiment of the invention, a third entanglement-preventing means (not shown) can be selectively provided to the fighter robots 10 and 20. Here, the third entanglement-preventing means (not shown), provided to the fighter robots 10 and 20, serves to prevent the power lines 61 and 62 from becoming entangled with each other on the opposite ends 42 and 43 or themselves when the rotary member 40 is rotating around the central axis 41. In an exemplary embodiment of the invention, only one of the second and third entanglement-preventing means can be selectively provided or both the second and third entanglement-preventing means can be provided. The second and third entanglement-preventing means will be described in more detail later.

As described above, in another exemplary embodiment of the invention, the fighter robot system can also include a controller 50 that controls the fighting robots 10 and 20 by providing control signals to the individual robots 10 and 20 with or without wires. The controller 50 can control the individual robots 10 and 20 with or without wires. In the case of the wired control, it is possible to supply power and provide control signals through the power lines 61 and 62. That is, it is possible to provide power and control signals using one power line 61 or 62. In addition, according to a further exemplary embodiment of the invention, the power supply 30 and the controller 50 can be provided as one unit.

Figure 2:
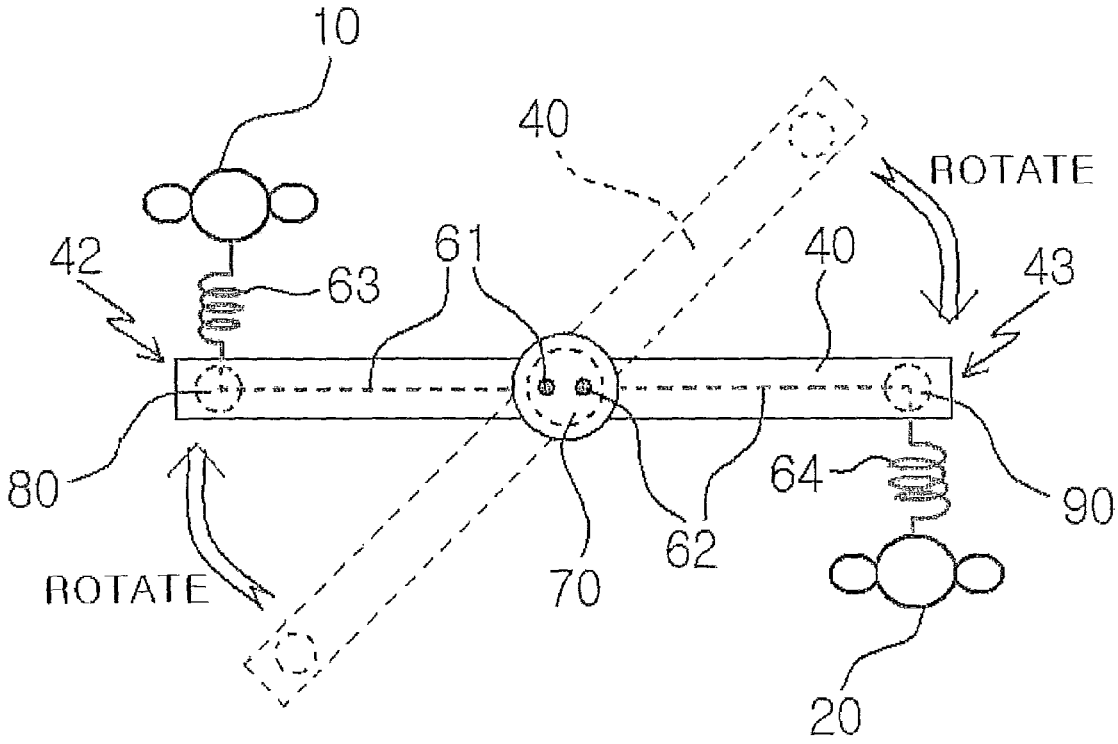
FIG. 2 is a top plan view showing a rotary member according to an exemplary embodiment of the invention.

FIG. 2 is a top plan view showing a rotary member according to an exemplary embodiment of the invention.

Referring to FIG. 2, the rotary member 40 according to this embodiment of the invention has the first entanglement-preventing means 70 in the central portion thereof, and the two power lines 61 and 62 are provided through the inside of the first entanglement-preventing means 70. The two power lines 61 and 62 extend again to the opposite ends 42 and 43 in the lengthwise direction of the rotary member 40 and are connected to the respective fighter robots 10 and 20 below.

Although not specifically shown in the drawing, the second entanglement-preventing means 80 and 90 can be provided on the opposite ends 42 and 42 of the rotary member 40. As described above, if the second entanglement-preventing means 80 and 90 is not provided, the third entanglement-preventing means (not shown) can be selectively provided in the fighter robots 10 and 20. It is preferred that the first to third entanglement-preventing means as described above be provided as the same device.

The first to third entanglement-preventing means prevent the two power lines 61 and 62 from becoming entangled when the rotary member 40 is rotating around the central axis 41. In other words, when the fighter robots 10 and 20 move to have a match against each other, the rotary member 40 naturally rotates following the movement of the fighter robots 10 and 20, since the fighter robots 10 and 20 are connected to the rotary member 40 via the power lines 61 and 62. This, as a result, prevents the two power lines 61 and 62 from becoming entangled with each other or themselves when the rotary member 40 is rotating.

Here, a portion 63 of the power line 61 is connected between one end 42 of the rotary member 40 and the fighter robot 10, and a portion 64 of the power line 62 is connected between the other end 43 of the rotary member 40 and the fighter robot 20. It is preferred that the portions 63 and 64 of the power lines 61 and 62 be configured to be variable in length. For example, the portions 63 and 64 of the power lines 61 and 62 can be configured as a spiral or coil so that the length can be varied following the movement of the fighter robots 10 and 20. The reason of this is not to cause pressure to the rotary member 40 even when the fighter robots 10 and 20 are moving to a place far from the rotary member 40 while having a match against each other.

Figure 3:
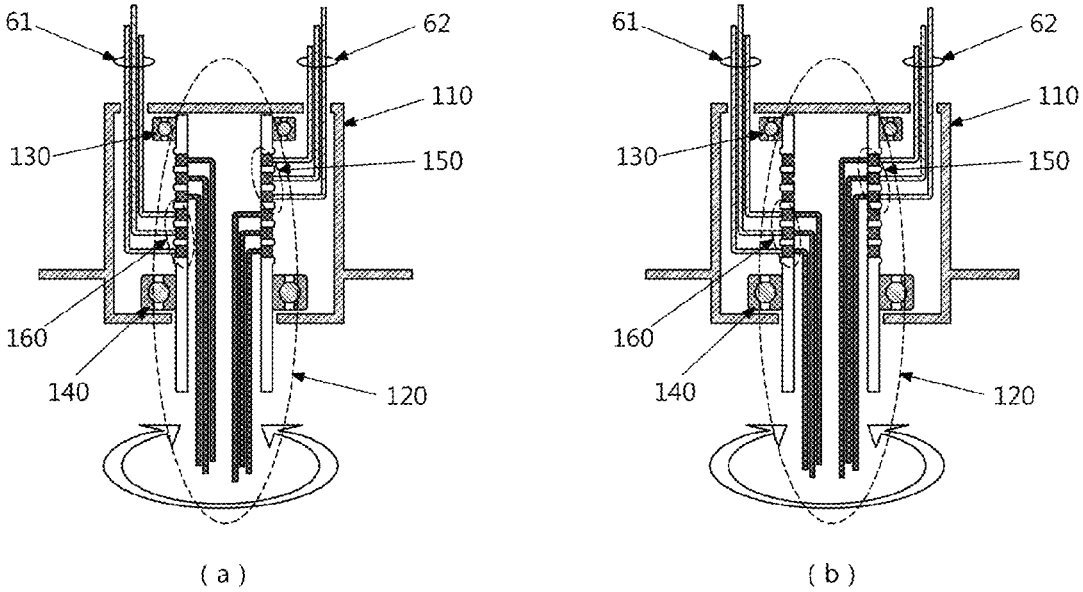
FIG. 3 is a cross-sectional view showing the internal structure of an entanglement-preventing means according to an exemplary embodiment of the invention.

FIG. 3 is a cross-sectional view showing the internal structure of an entanglement-preventing means according to an exemplary embodiment of the invention.

Referring to FIG. 3, an entanglement-preventing means 100 according to an exemplary embodiment of the invention generally includes an outer housing 110 and an inner rotary body 120. The inner rotary body 120 is connected to the above-described rotary member 40. Here, it is preferred that the outer housing 110 and the inner rotary body 120 be cylindrically configured. In this configuration, the inner rotary body 120 is provided inside the external housing 110 and is physically connected to the above-described rotary member 40, which is located below. Therefore, the rotary body 120 is configured to rotate 360° around the central axis following the rotation of the rotary member 40. For this, upper and lower bearings 130 and 140 are provided between the outer housing 110 and the inner rotary body 120 such that the inner rotary body 120 can rotate inside the external housing 110. In addition, contact portions 150 and 160 are provided in upper and lower inside portions of the external housing 110, in contact with the inner rotary body 120. The contact portions 150 and 160 are configured in the form of a circle that extends 360° along the inner circumference of the housing 110.

The power lines 61 and 62, extending from the power supply 30, are inserted into the external housing 110. Here, the power lines 61 and 62 are electrically connected to the upper and lower contact portions 150 and 160 formed between the external housing 110 and the inner rotary body 120. Specifically, one of the two power lines 61 and 62 is electrically connected to the upper contact portion 150, and the other one of the two power lines 61 and 62 is electrically connected to the lower contact portion 160. This electrical connection is continuously maintained even when the inner rotary body 120 is rotating inside the external housing 110. This will be described in more detail below with reference to FIGS. 3(*a*) and (*b*).

FIG. 3 shows that the inner rotary body 120 in part (a) and the inner rotary body 120 in part (b) are rotated 180° with respect to each other, following the rotation of the rotary member 40. First, referring to FIG. 3(*a*), the first power line 61 of the two power lines 61 and 62 is electrically connected to the upper contact portion 150, and the second power line 62 is electrically connected to the lower contact portion 160. Although the drawing shows that each of the power lines 61 and 62 includes three narrow electrical wires, this is merely an example but the power line can include one or more electrical wires. As such, in FIG. 3(*a*), the power lines 61 and 62 inserted into the external housing 110 are electrically connected to the power lines 61 and 62 of the rotary body 120 through the upper and lower contact portions 150 and 160, respectively. In addition, the power lines 61 and 62 continuously extend along the rotary member 40 and are connected to the fighter robots 10 and 20 through the opposite ends 42 and 43.

Next, FIG. 3(*b*) shows the state where the inner rotary body 120 is rotated 180° as the rotary member 40 rotates 180° from FIG. 3(*a*). Referring to FIG. 3(*b*), the first power line 61 of the two power lines 61 and 62 continues to be electrically connected to the upper contact portion 150, and the second power line 62 continues to be electrically connected to the lower contact portion 160, even when the rotary body 120 is rotating.

Therefore, as shown in FIGS. 3(*a*) and (*b*), the power lines 61 and 62 remain electrically connected to the respective contact portions 150 and 160 even when the inner rotary body 120 is rotating following the rotation of the rotary member 40.

Accordingly, the two power lines 61 and 62 do not become entangled even when the rotary member 40 is rotating.

The above-described entanglement-preventing means can be selectively provided in the central axis 41 and the opposite ends 42 and 43 of the rotary member 40 or in the fighter robots 10 and 20. According to an exemplary embodiment of the invention, it is preferred that the entanglement-preventing means be provided in the central axis of the rotary member 40, as well as in the opposite ends 42 and 43 of the rotary member 40 or the fighter robots 10 and 20. When the entanglement-preventing means is provided in the fighter robots 10 and 20, it can be more preferably provided on the heads of the robots in order to minimize contact with the power lines connected thereto.

According to an exemplary embodiment of the invention, the central axis 41 of the rotary member 40 can be configured as a shaft (not shown). The reason of this is to provide a more stable structure by using the shaft as a rotary axis. In addition, each of the power lines 61 and 62 can include a plurality of electrical wires so as to provide power as well as robot control signals. Such robot control signals are signals that control the robots through wires. Therefore, it is possible to provide power as well as robot control signals through one power line 61 or 62. For example, it is possible to employ Power Line Communication (PLC) in order to transmit data of the robot control signals using the power line, which is designed to supply power, as a transmission medium.

Figure 4:
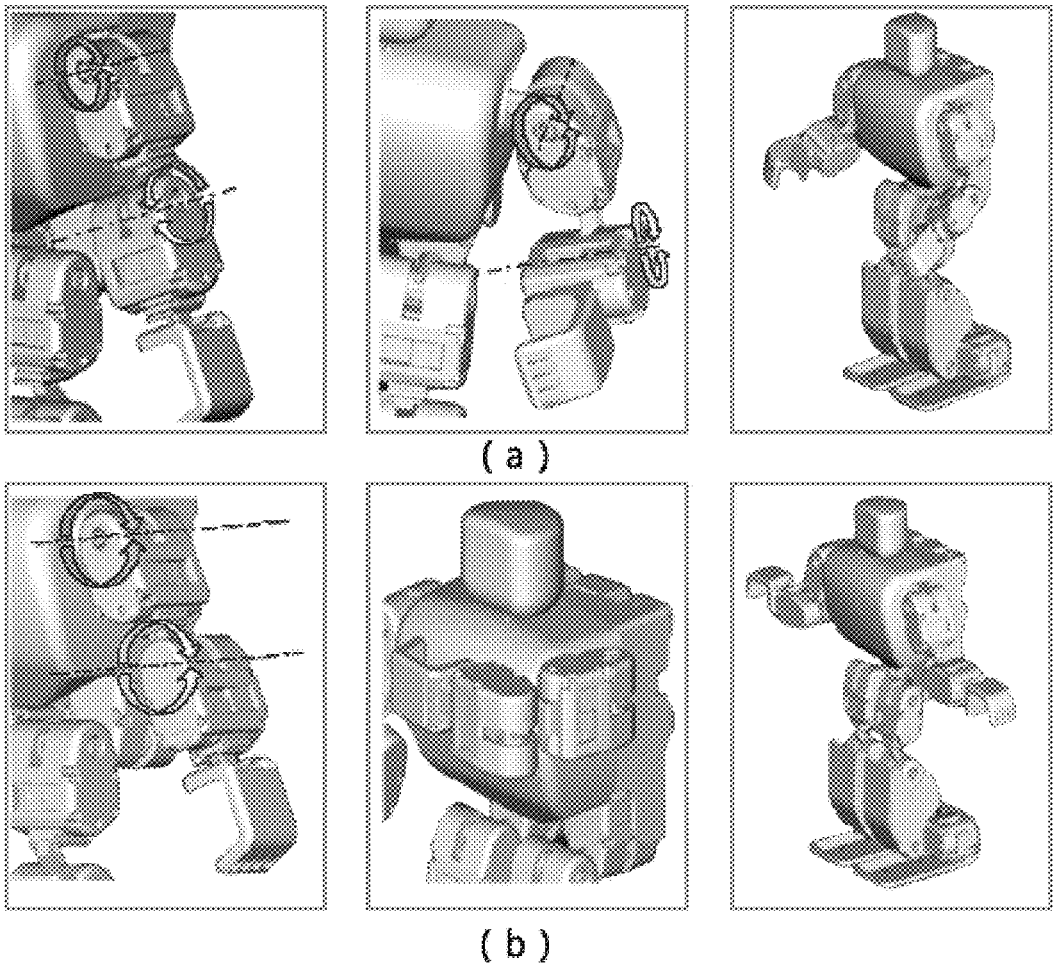
FIG. 4 is a schematic view showing the operations of an arm of a fighter robot according to an exemplary embodiment of the invention.

FIG. 4 is a schematic view showing the operations of an arm of a fighter robot according to an exemplary embodiment of the invention.

Referring to FIG. 4, in the fighter robot system according to an exemplary embodiment of the invention, it is important to prevent the robots 10 and 20 from coming into contact with their power lines 61 and 62 irrespective of the movement or operation of the robots 10 and 20, since power is supplied to the fighter robots 10 and 20 through wires. For this, it is preferred that the fighter robots 10 and 20 be set to operate their arms so that the arms do not come into contact with the power lines 61 and 62 connected to the robots 10 and 20.

As shown in the drawing, a humanoid robot, which generally has a three-axis arm system, can use two types of arm-coupling structures. In more detail, one of the arm-coupling structures is a walking type as shown in FIG. 4(*a*), the other one of the arm-coupling structures is a dancing type. In FIG. 4(*b*), the possibility that the arm of the robot might come into contact with the power line connected to the robot is high since the arm is bent toward the chest of the robot. However, in FIG. 4(*a*), the possibility that the arm of the robot 10 or 20 might come into contact with the power line 61 or 62 can be minimized since the arm is not bent toward the chest.

As described above, in an exemplary embodiment of the invention, the fighter robots 10 and 20 are set to operate their arms so that the arms do not come into contact with the power lines 61 and 62 connected to the robots 10 and 20.

The foregoing descriptions of specific exemplary embodiments of the present invention have been presented for the purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

INDUSTRIAL APPLICABILITY

Application of robots to the education and entertainment industries is actively proceeding. In particular, considering that attempts have been continued to apply robots to sport games, a solution that can stably supply power to the robots in the game through power lines while preventing the power lines from becoming entangled is becoming an important factor.

From this point of view, it is apparent that the invention is very suitable to fighter robots, since it can stably supply power to the robots through power lines while preventing the power lines from becoming entangled during the movement of the robots.

Furthermore, a variety of embodiments for preventing the power lines from becoming entangled can be made without departing from the scope of the technical principle of the invention and, in the future, can be very usefully applied to the game industry using robots.

What is claimed is:

1. A fighter robot system comprising:

two humanoid fighter robots configured to have a fight against each other, wherein the fighter robots are powered through wires and able to walk freely forward, backward and side to side to fight each other and meet each other when fighting;

a power supply providing power to the fighter robots; and a rotary member located above or below the fighter robots, the rotary member having a predetermined length and rotatable around a central axis according to a movement of the fighter robots, wherein the power supply provides the power to the fighter robots through power lines, each of the power lines starts from the power supply, extends from the central axis to either end of the rotary member in a lengthwise direction, and is connected at that end to a corresponding one of the fighter robots, and the rotary member rotates around the central axis following movement of the fighter robots, thereby preventing the power lines from becoming entangled, wherein each of the power lines is configured as a spiral such that the length of each power line is variable to freely correspond to movement of the fighter robots, wherein the rotary member includes a first entanglement-preventing means provided on the central axis, wherein the first entanglement-preventing means prevents the power lines extending from the power supply from becoming entangled on the central axis, wherein the rotary member includes a second entanglement-preventing means on opposite ends thereof, wherein the second entanglement-preventing means prevents the power lines connected to the two fighting robots from becoming entangled with each other or themselves, wherein the rotary member includes a third entanglement-preventing means provided on upper portions of the two fighting robots, wherein the third entanglement-preventing means prevents the power lines connected to the two fighting robots from becoming entangled with each other or themselves, and wherein each entanglement-preventing means includes an external housing and an inner rotary body, the inner rotary body being able to rotate inside the external housing, and wherein the power lines extending into the external housing from the power supply are electrically connected to upper and lower contact portions provided in upper and lower inside portions of the external housing in contact with the inner rotary body.

2. The fighter robot system according to claim 1, wherein the rotary member comprises a cylindrical body having a predetermined length such that the power lines are provided inside the cylindrical body.

3. The fighter robot system according to claim 1, wherein the rotary member includes a shaft provided on the central axis thereof.

4. The fighter robot system according to claim 1, further comprising a controller that controls the fighting robots by providing control signals to the fighting robots with or without wires.

5. The fighter robot system according to claim 4, wherein the power and the control signals are provided to each of the fighting robots through one power line.

6. The fighter robot system according to claim 4, wherein the power is alternating current power, and wherein power line communication provides the control signals on the alternating current power to the robots.

7. The fighter robot system according to claim 1, wherein each of the fighter robots is set to operate anus so that the arms do not come into contact with the power line connected to the robot.

* * * * *